US005234182A

United States Patent [19]

Renecle

[11] Patent Number: 5,234,182

[45] Date of Patent: Aug. 10, 1993

[54] KITE

[76] Inventor: Keith V. Renecle, 37 Beech Rd., Cresslawn, Kempton Park, Transvaal, South Africa

[21] Appl. No.: 883,483

[22] Filed: May 15, 1992

[30] Foreign Application Priority Data

May 17, 1991 [ZA] South Africa ..... 91/3748

[51] Int. Cl.[5] ..... B64C 31/06

[52] U.S. Cl. ..... 244/153 R

[58] Field of Search ..... 244/153 R, 153 A, 154, 244/34 A, 45 R

[56] References Cited

U.S. PATENT DOCUMENTS 1,328,143 1/1920 Fergusson ..... 244/153 R
2,941,765 6/1960 Feldman ..... 244/153 R
3,017,139 1/1962 Binder ..... 244/34 A
3,903,639 9/1975 Howell ..... 244/153 R
4,677,928 7/1987 Hoyt ..... 244/34 A
4,830,313 5/1989 Cheng ..... 244/153 R
5,011,100 4/1991 Gerstein ..... 244/153 R

*Primary Examiner*—Galen Barefoot
*Attorney, Agent, or Firm*—Burns, Doane, Swecker & Mathis

[57] ABSTRACT

The kite has a hollow, open-ended body that tapers down in cross-section from an operatively leading end to an operatively trailing end thereof. There is at least one panel spanning transversely across the interior of the body to maintain a smooth and uniform air flow through the kite body and to increase the flying stability of the kite. One or two flying lines are secured without a bridle to the kite.

7 Claims, 2 Drawing Sheets

KITE

BACKGROUND TO THE INVENTION

This invention relates to a kite.

Most currently available, low cost kites are unable to fly in stronger winds, say 20 knots or more, without breaking apart or becoming unstable. Generally speaking, it is only the more expensive and complicated kites that are able to fly competently in stronger winds.

There is nevertheless a constant search for a simple, inexpensive and easily constructed kite which can fly in both lighter and stronger winds.

SUMMARY OF THE INVENTION

According to the present invention there is provided a kite which comprises a hollow, open-ended body having an operatively leading end and an operatively trailing end, the body tapering down in cross-section from the operatively leading end to the operatively trailing end thereof, and at least one panel spanning transversely across the interior of the body.

The body and panel may be made of flexible sheet material, typically a plastics sheet material. Preferably, an operatively leading edge of the panel is reinforced by a spar of material which is more rigid than that of the panel itself. Conveniently, the spar is removably located in a tubular pocket provided at the operatively leading edge of the panel.

In the preferred embodiments, the or each panel extends from the operatively leading end of the body to the operatively trailing end, and the body tapers conically from the operatively leading end to the operatively trailing end thereof, it is also preferred that the operatively leading end of the body is defined by a leading edge lying in a plane which makes an acute angle with the axis of the body, with an operatively upper extremity of the leading edge extending forwardly beyond an operatively lower extremity thereof.

The kite may include a single flying line attached to the body at a point adjacent the operatively lower extremity of the leading edge. Alternatively, the kite may have a pair of flying lines attached to the body at spaced apart positions adjacent the leading edge.

In a case in which the kite has a single panel spanning across the interior of the body, it is preferred that the panel lies in a plane which is operatively horizontal and which includes the axis of the body. In multi-panel versions of the kite, the panels are preferably arranged in parallel, spaced apart relationship spanning across the interior of the body.

BRIEF DESCRIPTION OF THE DRAWINGS

The invention will now be described in more detail, by way of example only, with reference to the accompanying drawings in which.

DESCRIPTION OF EMBODIMENTS

Figure 1:
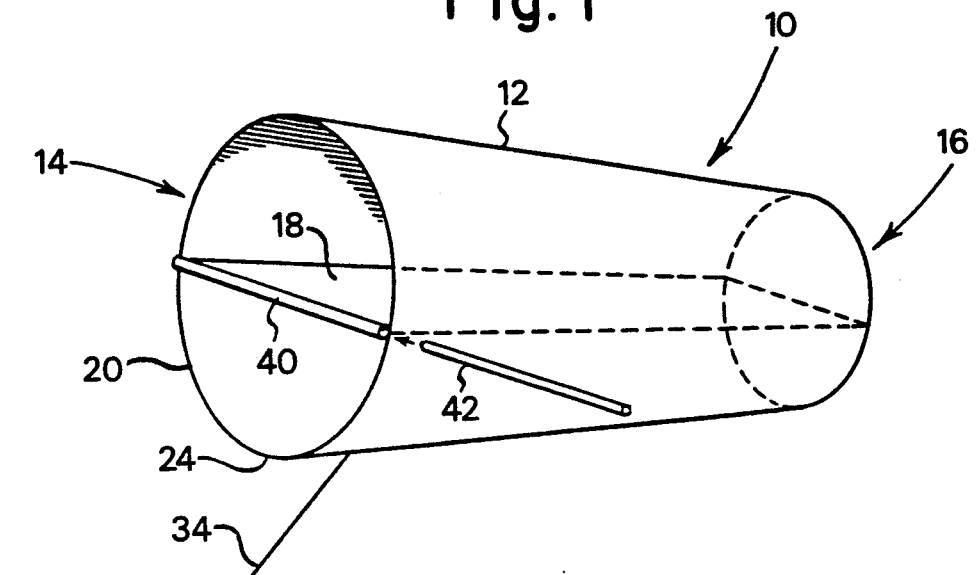
FIG. 1 shows an exploded, perspective view of a kite of the invention during flight.

The kite 10 illustrated in FIG. 1 has a hollow, open-ended body 12 which tapers down, in conical manner, from an operatively leading end 14 to an operatively trailing end 16. Spanning diametrically across the interior of the body 12, at an operatively horizontal attitude, is a panel 18. The body 12 and panel 18 are made of the same flexible material, in this case thin gauge polyethylene. The panel 18 extends from the operatively leading end to the operatively trailing end.

The leading end 14 of the kite body 12 is defined by a leading edge 20. As will be evident from FIG. 2, the operatively upper extremity 22 of the leading edge extends forwardly beyond the operatively lower extremity 24 of the leading edge. Thus the leading edge lies in a plane 26 which makes an acute angle 28 with the central axis of the body 12. The trailing end 16 of the body 12 is defined by a trailing edge 30 that lies in a plane 32 which is normal to the central axis.

Figure 2:
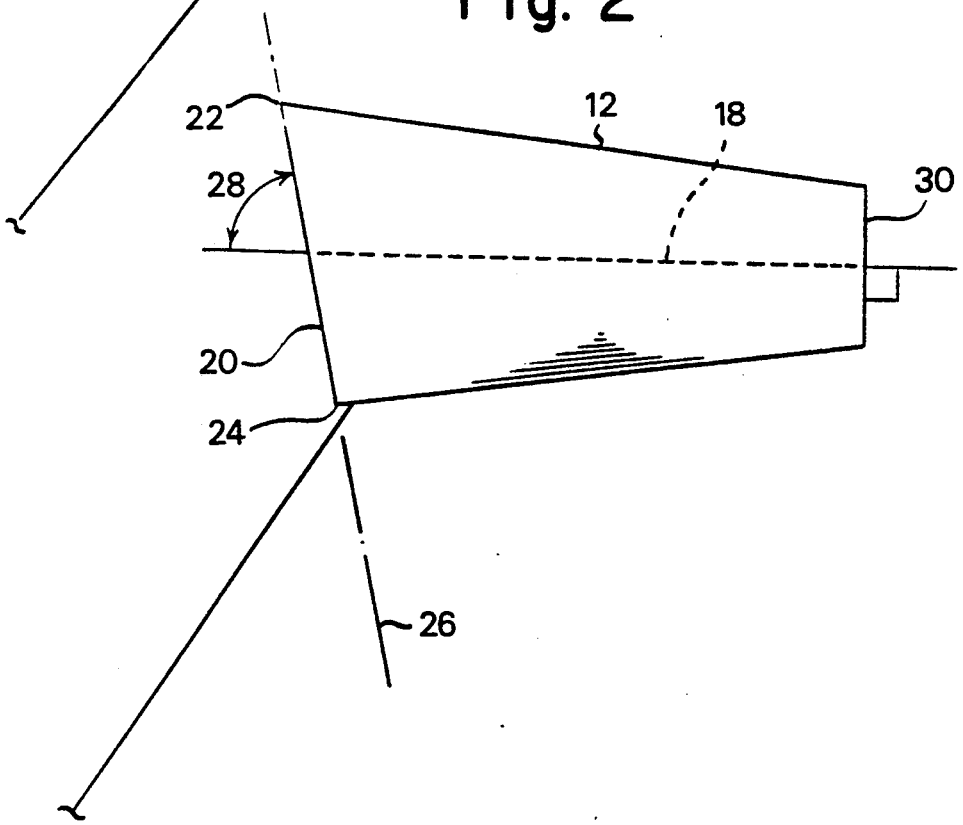
FIG. 2 shows a side view of the kite of FIG. 1.

In the first embodiment of FIGS. 1 and 2, there is a single flying line or string 34 which is attached to the body 12 close to the leading edge 20 at the lower extremity 24. Thus, the flying line 34 is attached without a bridle to the kite.

Figure 3:
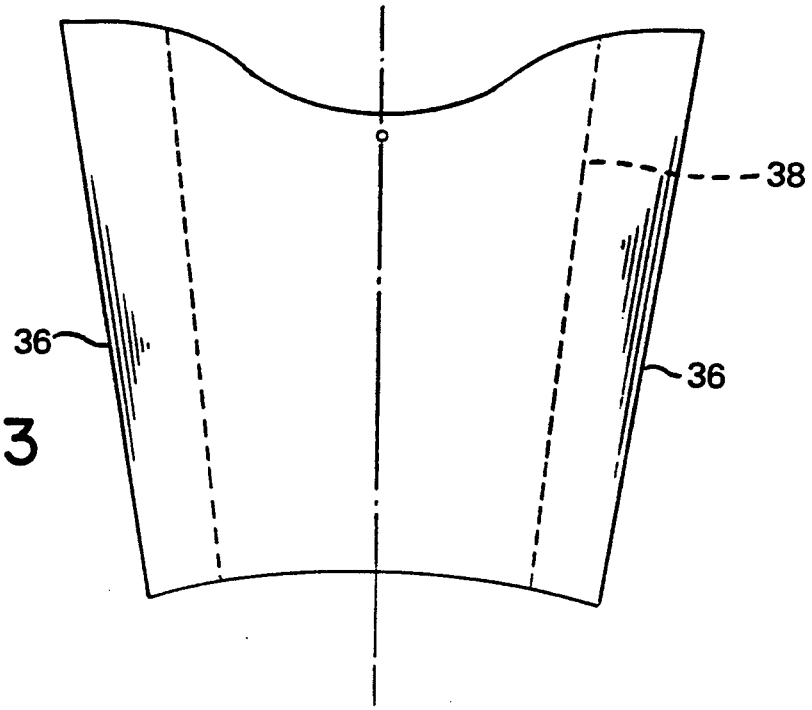
FIG. 3 illustrates the blank from which the main body of the kite is formed.

FIG. 3 shows a view of the blank from which the kite body 12 is formed. In practice, the illustrated blank is formed into a conically tapering tube as seen in FIG. 1 and the edges 36 are secured to one another, for instance by adhesive, adhesive tape, by welding or by any other appropriate method.

The panel 18 is of trapezoidal shape and the broken lines 38 in FIG. 3 indicate the positions at which the edges of the panel are secured to the inner surface of the body 12. Once again, such secural can be achieved by adhesive, adhesive tape, welding or other appropriate method.

As seen in FIG. 1, the leading edge of the panel 18 is formed into a tubular pocket 40. During assembly of the kite, a spar 42 is slipped lengthwise into the pocket 42. The spar may be provided by a length of wooden dowel, a length of tubular plastics or the like. The presence of the spar in the pocket 40 ensures that the leading edge of the panel 18 spans diametrically across the leading end of the kite body, and gives some rigidity to that leading edge.

In use, with the kite assembled in the manner described above, it is placed on the ground at an orientation for the leading end 14 to receive the prevailing air flow. Alternatively, a person could hold the kite at the appropriate orientation to receive the air flow. The air flow which enters the kite body 12 inflates it and causes it to fly.

It is believed that the conically tapering shape of the kite body 12 gives rise to a "ram-air" effect which can hold the kite airborne in all but the very lightest winds. Added to this, it is believed that the interior panel 18, which is horizontal during flight, gives rise to a smooth and uniform air flow through the kite body, and that this smooth air flow contributes to maintaining the kite in flight. It has been found that the provision of the internal panel also assists in maintaining the stability of the kite during flight.

Figure 4:
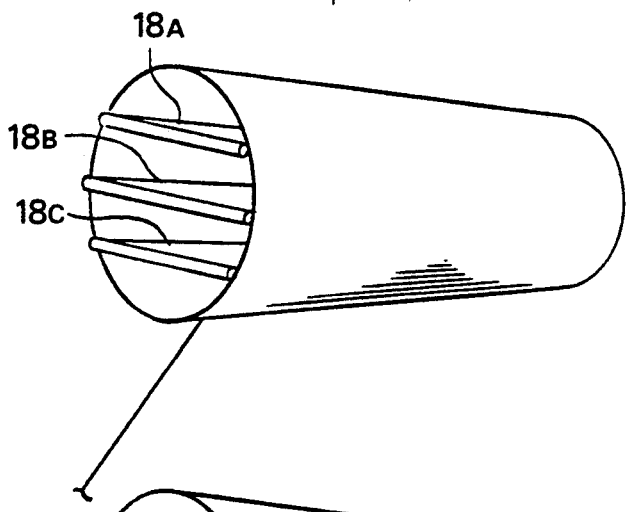
FIG. 4 shows a perspective view of a second embodiment of kite of the invention during flight.

FIG. 4 shows a slightly modified version which is provided with a number of parallel panels 18A, 18B and 18C. It is anticipated that this arrangement of internal panels will also contribute greatly to maintaining stability and a uniform and smooth air flow through the kite body 12, but has the attendant disadvantages of increased weight, complexity and cost.

Figure 5:
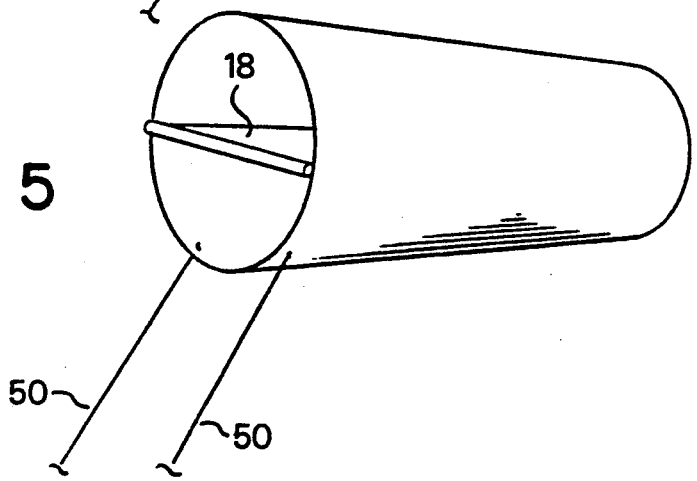
FIG. 5 shows a perspective view of a third embodiment of kite of the invention.

FIG. 5 shows another slightly modified version which has a single internal panel 18 but which is provided with two independent flying lines 50 secured without a bridle, to the kite body at spaced apart positions near to the leading edge 20 of the kite body 12. With this dual line arrangement, it is expected that the user will be able to steer the kite during flight by selectively pulling harder on one of the lines that the other.

A major advantage of the illustrated kites, and particularly the kite of FIGS. 1 and 2, is simplicity, ease of construction and low cost.

I claim:

1. A kite comprising:

a hollow open-ended body of flexible sheet material defining a longitudinal axis and having an operatively leading end and an operatively trailing end, the body tapering down in cross-section from the operatively leading end to the operatively trailing end thereof, the leading end of the body being defined by a leading edge lying in a plane which makes an acute angle with the longitudinal axis of the body, with an operatively upper extremity of the leading edge extending forwardly beyond an operatively lower extremity thereof.

at least one panel of flexible sheet material spanning transversely across the interior of the body and extending from the operatively leading end of the body to the operatively trailing end thereof, the operatively leading edge of the panel being reinforced by a rigid spar removably located in a tubular pocket of material, and a flying line attached without a bridle to the front end of the kite.

2. A kite according to claim 1 wherein the flying line is comprised of a single flying line.

3. A kite according to claim 1, wherein the flying line is comprised of a dual flying line.

4. A kite according to claim 1 wherein the flying line is attached to the body at a point adjacent the operatively lower extremity of the leading edge.

5. A kite according to claim 3 wherein the two flying lines of the dual flying line are attached to the body at spaced apart positions adjacent the leading edge.

6. A kite according to claim 1 where in the panel lies in a plane which is operatively horizontal and which includes the longitudinal axis of the body.

7. A kite according to claim 1 wherein there is a plurality of the panels, the panels being in parallel, spaced apart relationship.

* * * * *